US007712489B2

(12) United States Patent
Zan et al.

(10) Patent No.: US 7,712,489 B2
(45) Date of Patent: May 11, 2010

(54) PROCESS FOR THE ZERO EMISSION STORAGE OF SULPHUR

(75) Inventors: Leonardo Zan, Fano (IT); Francesco Crescenzi, Rome (IT)

(73) Assignees: ENI S.p.A., Rome (IT); Snamprogetti S.p.A., S. Donato Milanese (IT); Enitecnologie S.p.A., S. Donato Milanese (IT)

( * ) Notice: Subject to any disclaimer, the term of this patent is extended or adjusted under 35 U.S.C. 154(b) by 1378 days.

(21) Appl. No.: 10/991,529

(22) Filed: Nov. 19, 2004

(65) Prior Publication Data

US 2006/0042195 A1 Mar. 2, 2006

(30) Foreign Application Priority Data

Aug. 11, 2004 (IT) ..... MI2004A1644

(51) Int. Cl.
*B65B 1/04* (2006.01)
*E04B 1/00* (2006.01)

(52) U.S. Cl. ..... 141/1; 52/745.03

(58) Field of Classification Search ..... 141/1, 141/2, 18, 314–316; 52/745.03
See application file for complete search history.

(56) References Cited

U.S. PATENT DOCUMENTS 4,513,550 A * 4/1985 Kotcharian ..... 52/745.01
4,614,013 A * 9/1986 Stevenson ..... 29/897.34
4,934,122 A * 6/1990 Linquist ..... 52/745.01
5,234,191 A * 8/1993 Bambacigno et al. ..... 249/93
5,771,648 A * 6/1998 Miller et al. ..... 52/309.7
6,226,942 B1 * 5/2001 Bonin ..... 52/309.12
6,705,055 B2 * 3/2004 Ritter et al. ..... 52/309.11
6,718,712 B1 * 4/2004 Heath ..... 52/309.12
6,729,090 B2 * 5/2004 Messenger et al. ..... 52/309.12
7,287,356 B2 * 10/2007 Sacks et al. ..... 52/343

OTHER PUBLICATIONS

U.S. Appl. No. 12/440,859, filed Mar. 11, 2009, Zan.

* cited by examiner

*Primary Examiner*—Timothy L Maust
(74) *Attorney, Agent, or Firm*—Oblon, Spivak, McClelland, Maier & Neustadt, L.L.P.

(57) ABSTRACT

A storage tank that stores sulphur with zero emissions uses reinforced EPS panels and an impermeable bottom. The reinforced EPS panels are reinforced with networks of horizontal and/or vertical galvanized or stainless steel wires that are interconnected by galvanized or stainless steel orthogonal wires. Both inner and outer walls of the reinforced EPS panels are plastered before sulphur is placed in the storage tank. Larger storage tanks may be assembled by vertically interconnecting one or more reinforced EPS panels. This interconnection is achieved by corrugating the reinforced EPS panels, or forming their edges in a Greek-key shape. The Greek-key shape prevents sulphur from escaping the storage tank.

15 Claims, 5 Drawing Sheets

PROCESS FOR THE ZERO EMISSION STORAGE OF SULPHUR

The present invention relates to a process for the zero emission storage of sulphur by making use of suitable panels.

Sulphur, obtained in the liquid state from hydrocarbon fields through the Claus process, is currently stored as large dimensional blocks (in the order of hundreds of meters). These blocks are formed using aluminum panels which are removed after solidification of the sulphur (Pouring), thus leaving huge volumes of material exposed to the atmosphere.

These storage methods of the known art create various environmental problems relating to:

- structural yielding, material collapse and direct erosion with the consequent removal of fine particles;
- formation of sulphuric acid by the action of bacteria, with a polluting effect on the soil and water table.

We have now found a process that makes use of suitable panels, which allows the problems relating to the technologies of the known art currently adopted for sulphur storage, to be overcome.

The process for the zero emission storage of sulphur, object of the present invention, effected by the use of a storage tank having one or more levels, is characterized in that said storage tank, which has an impermeable bottom, essentially consists of reinforced EPS (expanded polystyrene) panels.

More specifically, the process preferably comprises the following steps:

- preparation of a bottom suitable for sustaining upper loads;
- preparation of an impermeable storage tank bottom, equipped with collecting containers for rain and percolated water;
- positioning of the reinforced EPS panels and interconnection of the same for forming the first level of the storage tank;
- plastering of the inner walls of said panels;
- pouring of the liquid sulphur until the first level of the storage tank is filled;
- possible further positioning of the EPS panels and interconnection of the same for forming further levels of the storage tank, followed by plastering of the inner surfaces of said panels and subsequent pouring of liquid sulphur until each further level of the storage tank is filled;
- covering of the horizontal surfaces of sulphur exposed to the atmosphere, by means of suitable materials;
- plastering of the outer walls of the storage tank.

The plastering of the inner/outer walls of said panels is preferably effected with mortar cement or epoxy resins.

The covering of the horizontal surfaces of sulphur is preferably effected:

- by means of reinforced polystyrene,
- by means of polyethylene (PE) sheet;
- by putting them in contact with soluble inorganic salts having concentrations ranging from 0.4 N to saturation, and possibly subsequently shielded by a suitable covering.

The light modular panels consist of reinforced expanded polystyrene, preferably a slab of expanded polystyrene (EPS) sandwiched between two electro-welded networks made of horizontal and vertical stainless or galvanized steel wire.

The two electro-welded networks are connected by galvanized or stainless steel wires, perpendicular to the net surfaces: in this way a framework is produced, which blocks both the joint rotations and relative longitudinal and transverse movements between the two electro-welded networks, thus creating a plate effect which provides the element with a considerable non-deformability.

The weight of said panels preferably ranges from 4 to 15 $kg/m^2$, more preferably from 4 to 10 $kg/m^2$, which allows easy handling and positioning of the panels.

The panels are preferably made "singly" (EPS sheet between two electro-welded and interconnected networks), but can also be made "doubly" (two single panels connected with electro-welded steel wires, at a distance preferably ranging from 8 to 25 cm).

The density of said panels preferably ranges from 15 to 25 $kg/m^3$, more preferably from 20 to 25 $kg/m^3$.

The polystyrene contained in the panels can be suitably shaped into corrugated and/or Greek-key plates, having a thickness preferably not less than 4 cm.

The steel or stainless steel wire preferably has a breaking point $ftk \geqq 540\ N/mm^2$ (Fe B 44 k).

The thickness of the horizontal, vertical or orthogonal wires is preferably equal to or higher than 3, more preferably equal to or higher than 4.

The networks preferably have square meshes equal to or less than 10×10 cm.

The electro-welded network can be possibly folded to connect the angular fixing elements to the tank edges.

With respect to covering the horizontal surfaces of the sulfur by putting them in contact with inorganic salts, it should be noted that this has already been described in patent application IT-MI2003A000882 which claims a method for inhibiting the acidification of water which comes into contact with materials containing sulfur in reduced form or with elemental sulfur, susceptible to oxidation on the part of *Thiobacilli*, which comprises putting these materials in contact with soluble inorganic salts at concentrations ranging from 0.4 N to saturation.

Inorganic salts, at the above concentrations, exert a bacteriostatic action on the *Thiobacilli*, preventing the lowering of the pH which remains close to neutrality.

In order to obtain the necessary effect for inhibiting acidification, inorganic salts can be used which are harmless from an environmental point of view, such as chlorides, sulfates, nitrates of mono or bivalent cations at concentrations ranging from 0.4 N to saturation.

NaCl is preferably used, at a concentration ranging from 0.5 equivalents/litre to saturation.

If the salt concentration is brought, by dilution, to levels lower than those necessary for inhibition, the acidification is normally re-established. In order to obtain the desired effect, it is therefore necessary to maintain the concentration of the solution in contact with the *Thiobacilli* at the established levels. For these storage systems, it is advisable to prevent the salt from being washed away from the surface of the sulfur by protecting it with an adequate covering.

This can be possibly achieved with an impermeable material, which is effective in preventing the salt from being washed away, bearing in mind, in the engineering phase, the possibility of the accumulation of toxic gases.

Alternatively, a low cost covering can be produced with inert granulated materials having a suitable thickness, possibly containing small quantities of hydraulic ligands to prevent their erosion. Said covering is permeable to gases and effective for preventing the salt from being washed away.

For this purpose, materials of the type: sand, gravel, pozzolan, have proved to be effective materials and, as ligands, lime or cement. Alternatively, soil or excavation materials can be used.

An example is provided, which represents an embodiment of the present invention, but which should not be considered as limiting its scope.

EXAMPLE

The following example relates to the storage of 10 $m^3$ of sulfur by the production of a tank with reinforced expanded polystyrene panels according to the invention.

Preparation of the Panels

Figure 1:
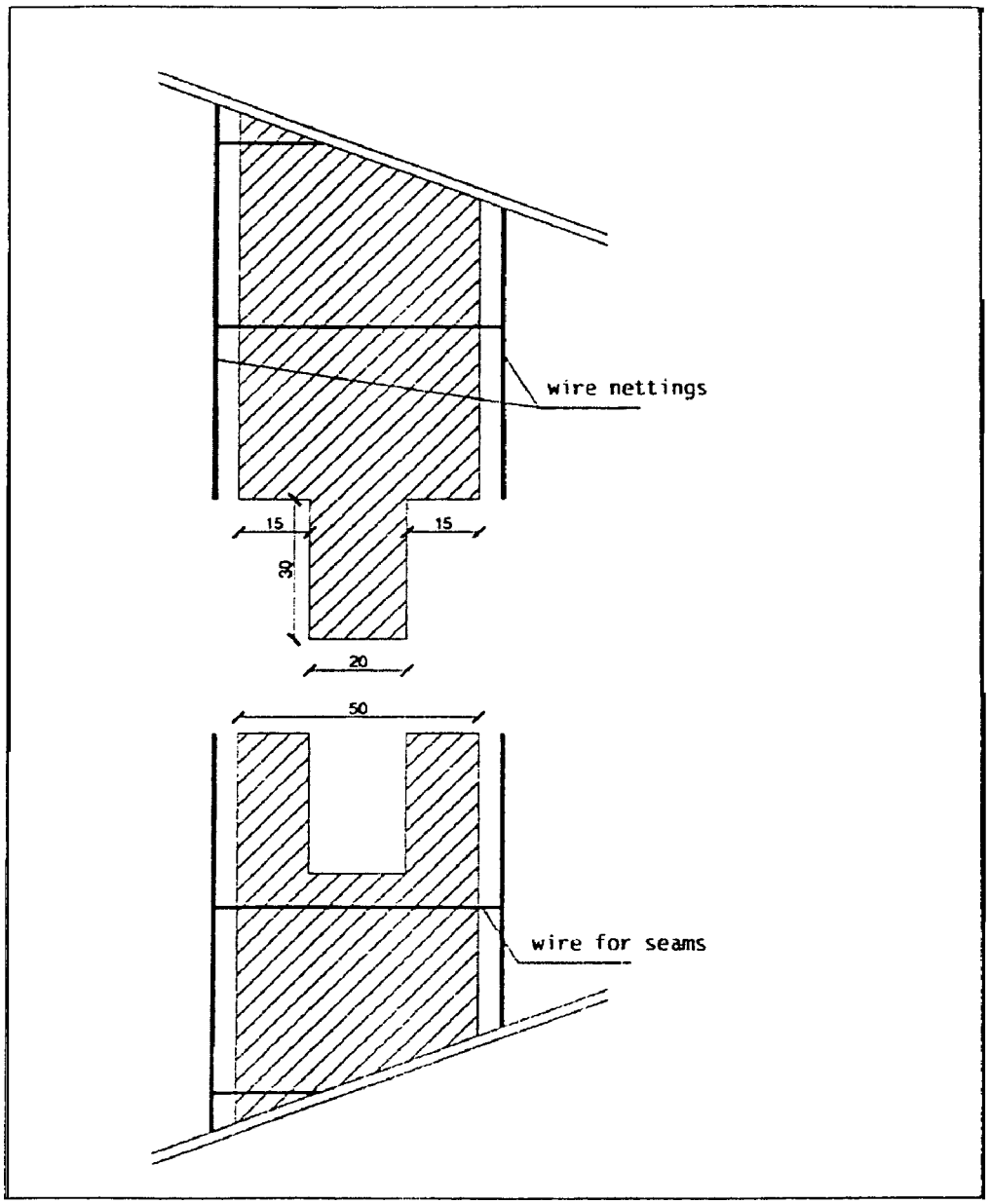
FIG. 1 is a sectional view of a detail of the male-female joint.

The prefabricated panels have the following properties (see FIG. 1, which shows a sectional view of a detail of the male-female joint:

Density of the polystyrene: 20 $kg/m^3$;

Thickness of the polystyrene: 50 mm;

Shape of the polystyrene: Greek-key profile;

Thickness of the joint: 20 mm;

Height of the joint: 30 mm;

Vertical wire diameter: 6 mm;

Horizontal wire diameter: 6 mm;

Wire diameter for seams: 4 mm;

Metallic network mesh dimensions: 8×8 cm.

Figure 2:
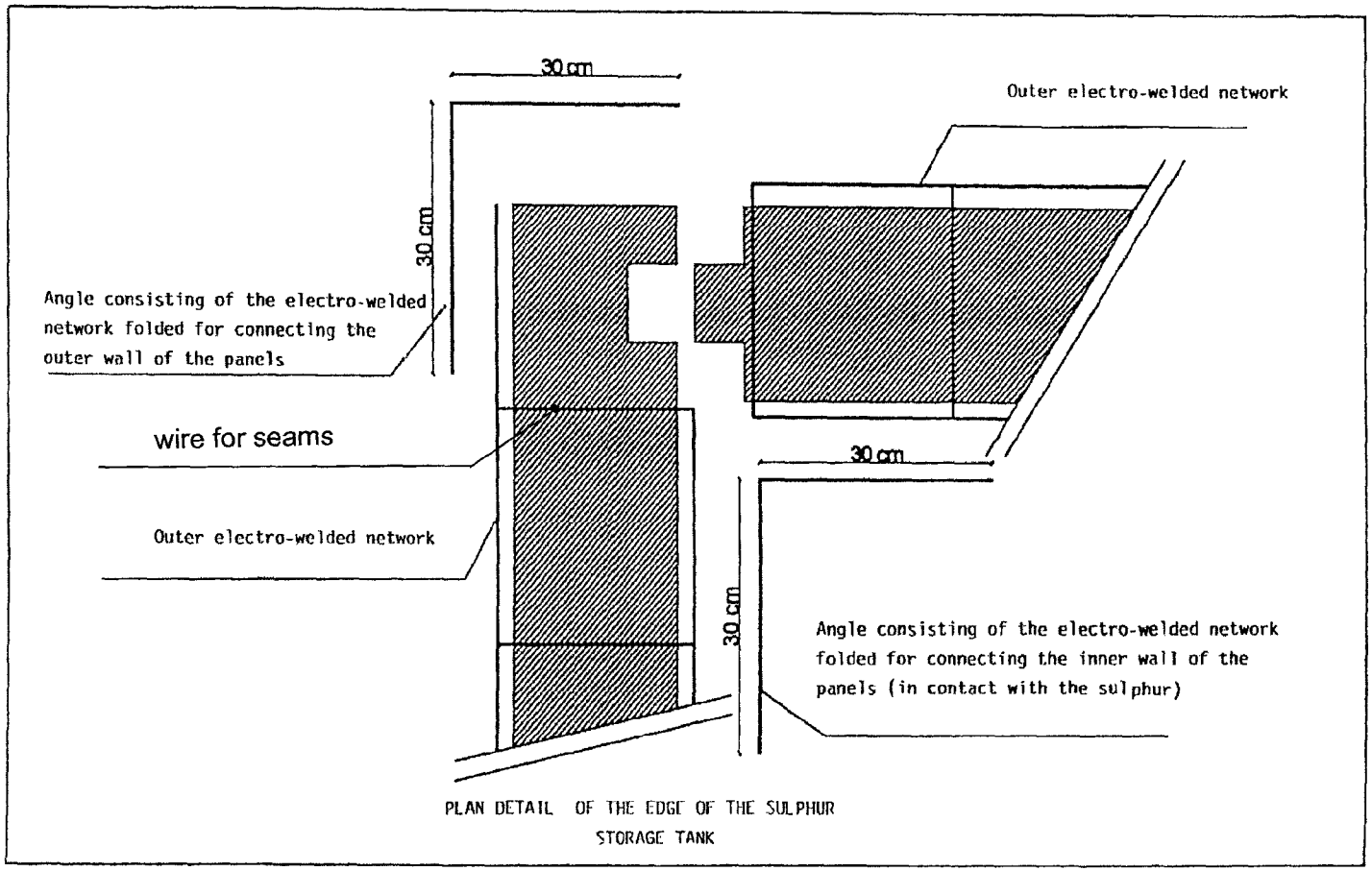
FIG. 2 shows binding to an upper panel.

Two simple panels having a height of 1200 mm and a length of 3000 mm; the polystyrene is shaped into Greek-key sheets with joints of the male-female type for the vertical connections and at the edges; the internal steel network (which will come into contact with the sulfur) is of the stainless steel type, the outer steel network is of the galvanized type, the steel for the seams is of the stainless steel type. The internal metallic network is folded at a right angle for a length of 30 cm approximately, the outer network is extended with respect to the polystyrene head by about 30 cm to allow the subsequent binding with the upper panel (see FIG. 2). Said panels are inserted into the ground for a depth of about 50 cm and form the first two side walls of the tank.

Figure 3:
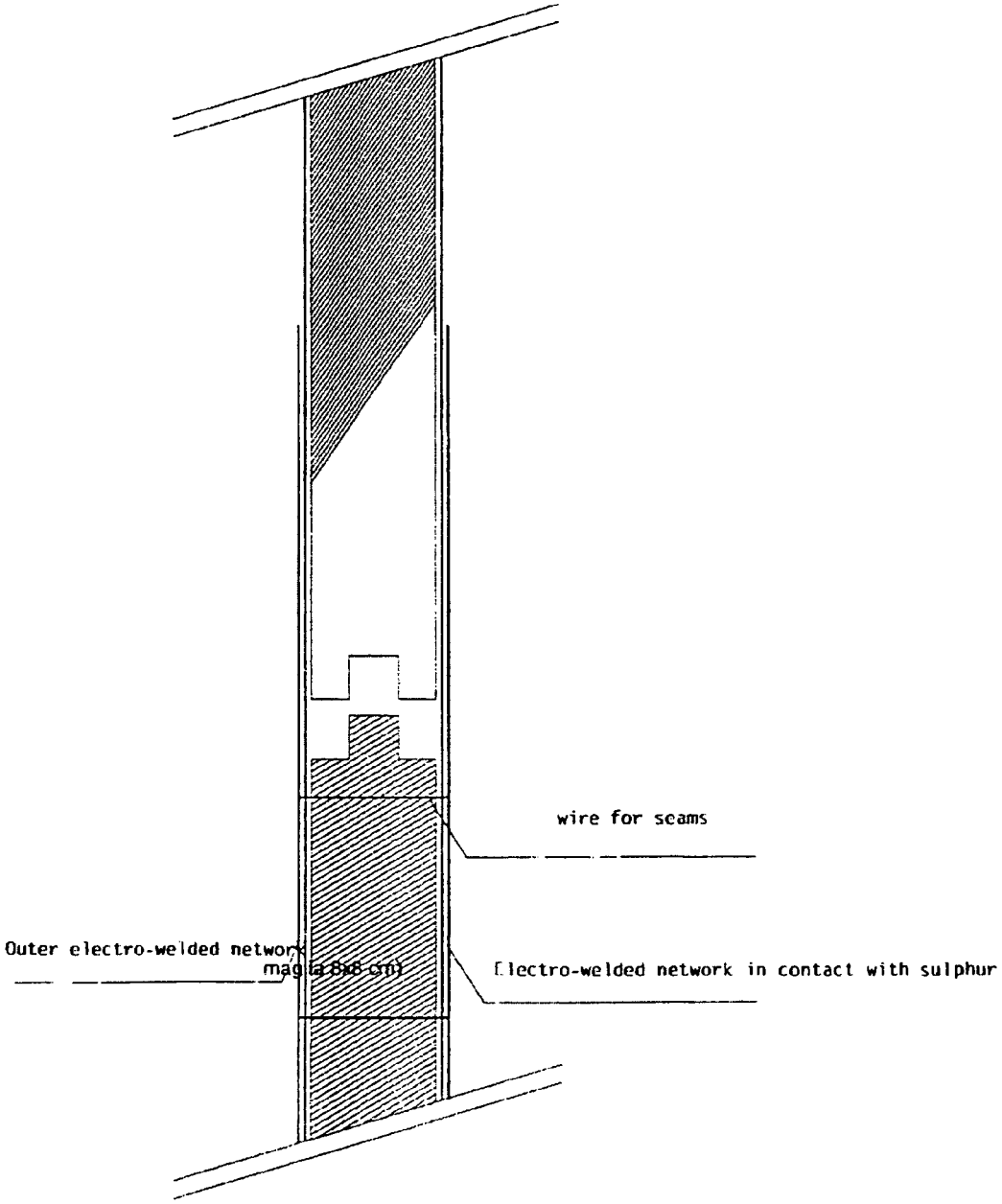
FIGS. 3 and 4 show two different connections between vertical panels.
Figure 4:
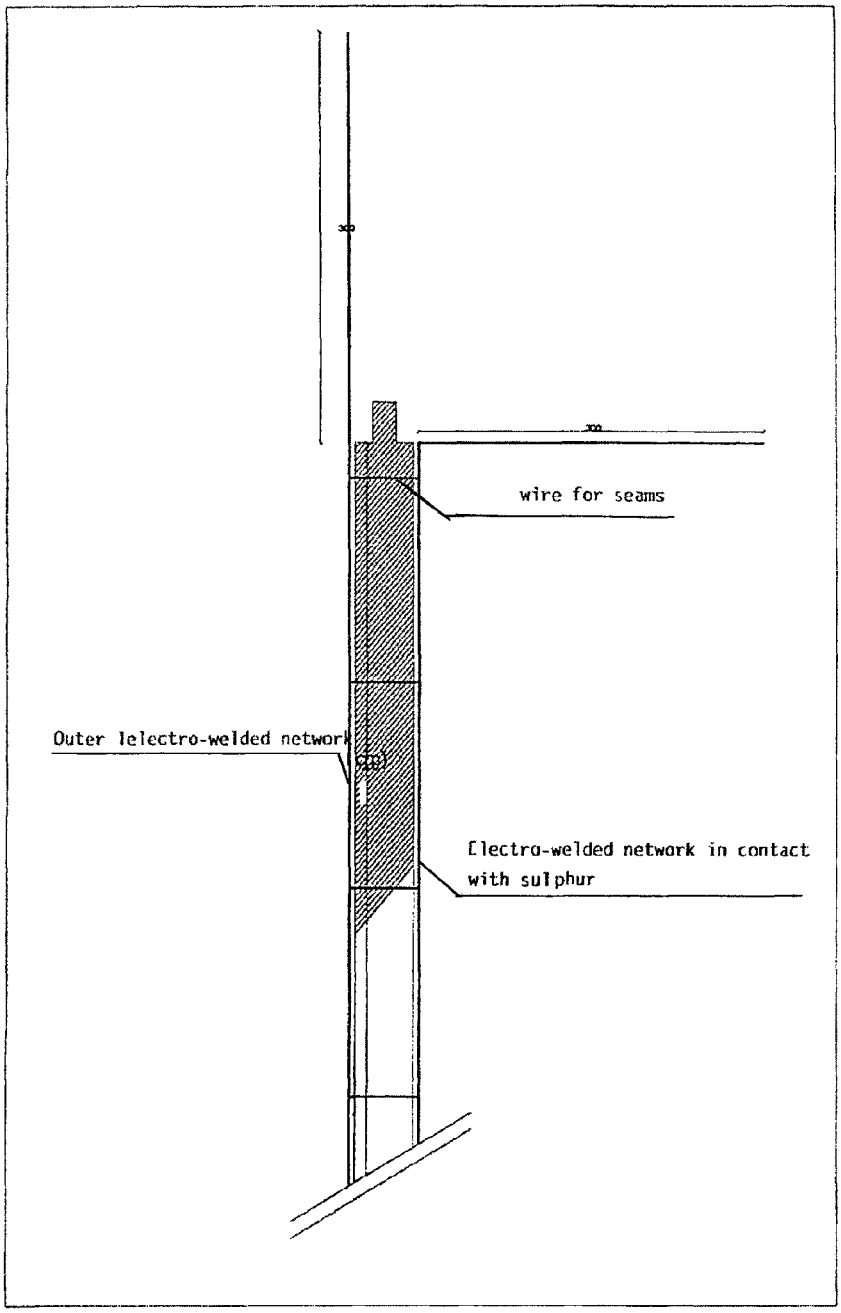

The panels for the vertical completion of the sulfur storage tank are produced with the same two characteristics described above, with the only difference that the height of each panel is equal to 600 mm, superimposition is obviously effected between two panels of the same type. (FIGS. 3 and 4 represent two different connections between vertical panels).

Sixteen folded electro-welded networks are also supplied (total width 60 cm, width of each single fold 30 cm) to produce the angular elements for fixing to the edges of the tank.

The height of the metallic networks pressure-folded is:

8 networks: approx. 70 cm;

8 networks: approx. 60 cm

These steel networks have a square mesh 8×8 cm, a diameter of the horizontal and vertical wires of 6 mm; the steel used is as follows:

for 4 networks: stainless steel for the connection of the internal part of the modules in contact with the sulfur;

for 4 networks: galvanized steel for the connection of the internal part of the modules in contact with the sulfur;

for 8 networks: galvanized steel for the connection of the outer part of the modules not in contact with the sulfur.

Figure 5:
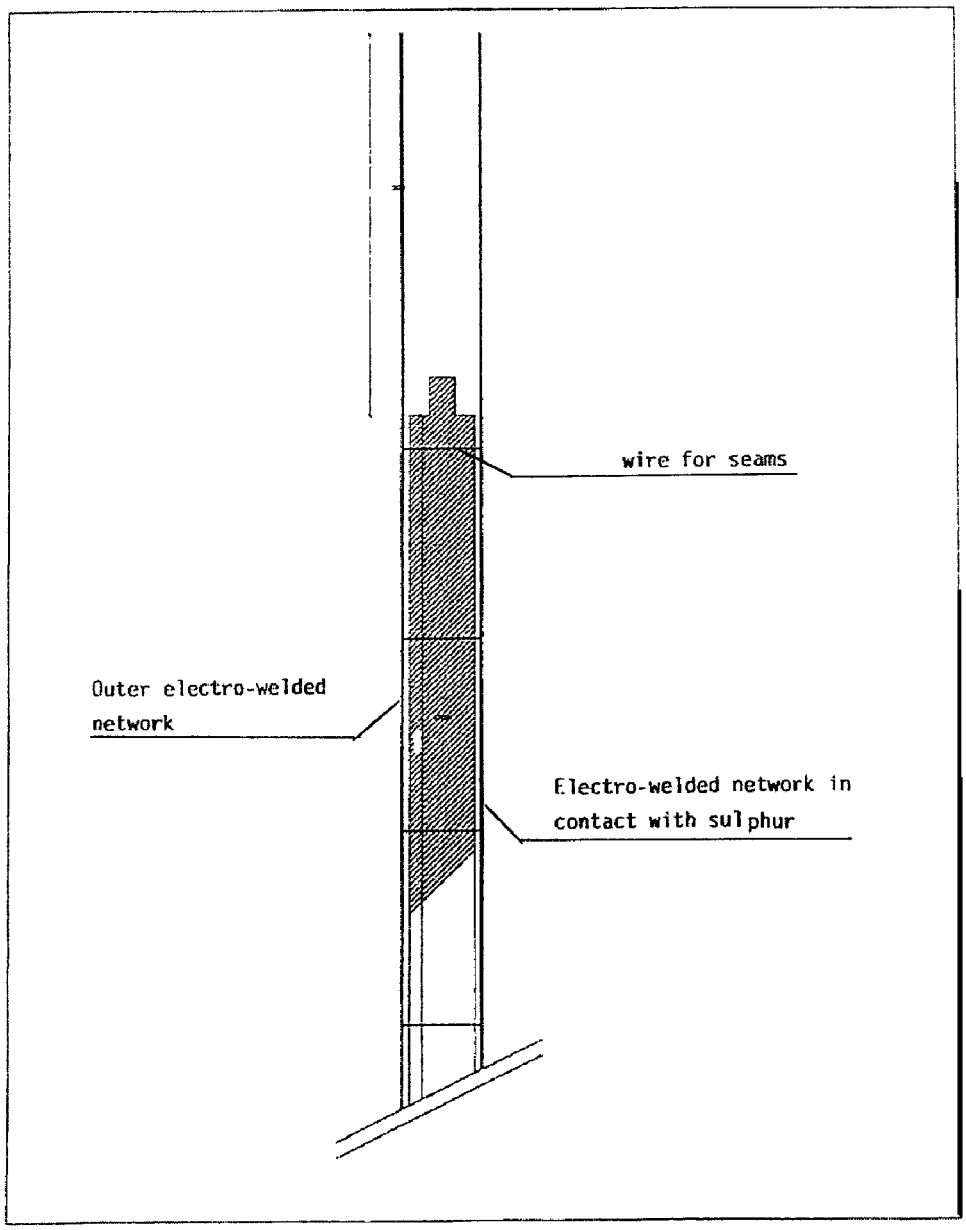
FIG. 5 shows connections between angular elements and metallic networks of panels.

The connections between the angular elements and metallic networks of the panels are effected by binding or with metal clips (see FIG. 5).

Setting Up

The setting up of the panels is effected as follows:

a. digging to a depth of 50 cm and a width of 30 cm along the perimeter of the storage tank;

b. laying of the wall panels having a height of 1200 mm inside the excavation previously effected and their interconnection to the edges by binding the angles to the existing electro-welded networks; the connection is effected so that the male-female type joints present at the edges adhere as much as possible thus preventing leakage of the liquid sulfur;

c. joining to the base with a jet of concrete resistant to sulfate attack (exposure group XA2 or XA3 according to regulation UNI-EN206);

d. upon the hardening of the concrete, the first 30 cm of sulfur are introduced, in the liquid state;

e. this is followed by the subsequent laying of the remaining panels having a height of 600 mm, said panels are connected in relation to their type along the superimposition lines of the networks on one or both of the sides with bindings in wire or with metal clips, also activating the reinforcing networks envisaged at the angles, the connections are effected so that the male-female type joints adhere as much as possible to avoid leakage of the liquid sulfur;

f. once the storage tank has been completed, jets of liquid sulfur are applied in layers of 30 cm up until the predicted storage of about 10 $m^3$.

The four side walls of the storage tank are internally and externally plastered with mortar cement or resins having a thickness of about 1 cm to obtain the sealing of both the connecting joints and discontinuities present in the walls corresponding to the orthogonal connections between the two metallic networks.

The invention claimed is:

1. A process for zero emission storage of sulfur, using a reinforced EPS storage tank having one or more levels and impermeable bottom, the process comprising:

preparing a bottom suitable for sustaining upper loads;

preparing an impermeable storage tank bottom, equipped with collecting containers for rain and percolated water;

positioning and interconnecting reinforced EPS panels to form a first level of the storage tank;

plastering the inner walls of said EPS panels;

pouring liquid sulfur until the first level of the storage tank is filled;

covering horizontal surfaces of the sulfur exposed to an atmosphere using materials preventing exposure of the sulfur to an atmosphere; and plastering outer walls of the storage tank.

2. The process according to claim 1, wherein the plastering is effected with mortar cement or epoxy resins.

3. The process according to claim 1, wherein the covering of the horizontal sulfur surfaces includes, covering the horizontal sulfur surfaces with reinforced polystyrene, covering the horizontal sulfur surfaces with polyethylene (PE) sheets, and treating the horizontal sulfur surfaces with soluble inorganic salts having concentrations ranging from 0.4 N to saturation, and possibly subsequently shielding the horizontal sulfur surfaces with a suitable covering.

4. The process according to claim 1, wherein the reinforced EPS panels have a weight ranging from 4 to 15 kg/m$^2$.

5. The process according to claim 4, wherein the reinforced EPS panels have a weight ranging from 4 to 10 kg/m$^2$.

6. The process according to claim 1, wherein the EPS panels are produced "singly" by means of an EPS sheet between two electro-welded and interconnected networks.

7. The process according to claim 1, wherein the EPS panels have a density ranging from 15 to 25 kg/m$^3$.

8. The process according to claim 7, wherein the EPS panels have a density ranging from 20 to 25 kg/m$^3$.

9. The process according to claim 1, wherein polystyrene in the panels is specifically shaped into corrugated and/or Greek-key sheets having a thickness of not less than 4 cm.

10. The process according to claim 1, wherein the panels further include galvanized or stainless steel horizontal, vertical or orthogonal wire which has a breaking point ftk equal to or greater than 540 N/mm$^2$ (Fe B 44 k).

11. The process according to claim 1, wherein the panels further include horizontal, vertical or orthogonal wires which have a thickness equal to or greater than 3 mm.

12. The process according to claim 11, wherein the horizontal, vertical or orthogonal wires have a thickness equal to or greater than 4 mm.

13. The process according to claim 6, wherein the electro-welded networks have square meshes equal to or less than 10×10 cm.

14. The process according to claim 6, wherein the electro-welded network is folded for the connection of angular elements for fixing to the edges of the tank.

15. The process according to claim 1, further comprising:

positioning and interconnecting further BPS panels to form further levels of the storage tank; and plastering inner surfaces of said further BPS panels and subsequent pouring of liquid sulfur until each further level of the storage tank is filled.

* * * * *